US006499528B1

(12) United States Patent
Johnson

(10) Patent No.: US 6,499,528 B1
(45) Date of Patent: Dec. 31, 2002

(54) ADJUSTABLE WINDOW COVERING APPARATUS

(76) Inventor: Althea L. Johnson, 790 Concourse Village West, Apt. 5 K, Bronx, NY (US) 10451

( * ) Notice: Subject to any disclaimer, the term of this patent is extended or adjusted under 35 U.S.C. 154(b) by 0 days.

(21) Appl. No.: 09/944,026

(22) Filed: Aug. 31, 2001

(51) Int. Cl.[7] ..... A47H 7/00
(52) U.S. Cl. ..... 160/350; 160/351
(58) Field of Search ..... 160/350, 351, 160/327, 328, 369, 371, 372, 377

(56) References Cited

U.S. PATENT DOCUMENTS

| | | | | | |
|---|---|---|---|---|---|
| 421,383 | A | * | 2/1890 | Carey et al. | 160/350 |
| 1,606,401 | A | * | 11/1926 | Craft | 160/350 |
| 2,104,416 | A | * | 1/1938 | De Ment | 160/350 |
| 2,182,396 | A | | 12/1939 | Copp | |
| 2,186,510 | A | * | 1/1940 | Walter et al. | 160/350 |
| 3,948,308 | A | | 4/1976 | Facey | |
| 4,127,196 | A | | 11/1978 | Boucher | |
| 4,825,611 | A | | 5/1989 | Bassett | |
| 5,421,394 | A | * | 6/1995 | Forrest | 160/350 |
| 5,472,102 | A | * | 12/1995 | Clayton | 160/350 X |
| 5,547,010 | A | | 8/1996 | Stuart | |
| D396,065 | S | | 7/1998 | Johnson et al. | |

* cited by examiner

*Primary Examiner*—David M. Purol

(57) ABSTRACT

An adjustable window covering apparatus that allows a user to install an adjustable window covering apparatus without the use of measuring tools, levelers or drills. The adjustable window covering apparatus includes a frame that is adapted for engaging a floor of a building proximate the window such that the frame is positioned in front of the window. A covering member is coupled to the frame. The covering member has an area for covering the window. The covering member is adapted for inhibiting viewing into the building from outside the building when the frame is positioned proximate the window of the building.

9 Claims, 3 Drawing Sheets

ADJUSTABLE WINDOW COVERING APPARATUS

BACKGROUND OF THE INVENTION

1. Field of the Invention

The present invention relates to window treatments and more particularly pertains to a new adjustable window covering apparatus for allowing a user to install an adjustable window covering apparatus without the use of measuring tools, levelers or drills.

2. Description of the Prior Art

The use of window treatments is known in the prior art. More specifically, window treatments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,547,010; 4,825,611; 4,127,196; 2,182,396; 3,948,308; and Des. 396,065.

While these devices fulfill their respective, particular objectives and requirements, the aforementioned patents do not disclose a new adjustable window covering apparatus. The inventive device includes a frame that is adapted for engaging a floor of a building proximate the window such that the frame is positioned in front of the window. A covering member is coupled to the frame. The covering member has an area for covering the window. The covering member is adapted for inhibiting viewing into the building from outside the building when the frame is positioned proximate the window of the building.

In these respects, the adjustable window covering apparatus according to the present invention substantially departs from the conventional concepts and designs of the prior art, and in so doing provides an apparatus primarily developed for the purpose of allowing a user to install an adjustable window covering apparatus without the use of measuring tools, levelers or drills.

SUMMARY OF THE INVENTION

In view of the foregoing disadvantages inherent in the known types of window treatments now present in the prior art, the present invention provides a new adjustable window covering apparatus construction wherein the same can be utilized for allowing a user to install an adjustable window covering apparatus without the use of measuring tools, levelers or drills.

The general purpose of the present invention, which will be described subsequently in greater detail, is to provide a new adjustable window covering apparatus apparatus and method which as many of the advantages of the window treatments mentioned heretofore and many novel features that result in a new adjustable window covering apparatus which is not anticipated, rendered obvious, suggested, or even implied by any of the prior art window treatments, either alone or in any combination thereof.

To attain this, the present invention generally comprises a frame that is adapted for engaging a floor of a building proximate the window such that the frame is positioned in front of the window. A covering member is coupled to the frame. The covering member has an area for covering the window. The covering member is adapted for inhibiting viewing into the building from outside the building when the frame is positioned proximate the window of the building.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable window covering apparatus apparatus and method which has many of the advantages of the window treatments mentioned heretofore and many novel features that result in a new adjustable window covering apparatus which is not anticipated, rendered obvious, suggested, or even implied by any of the prior art window treatments, either alone or in any combination thereof.

It is another object of the present invention to provide a new adjustable window covering apparatus, which may be easily and efficiently manufactured and marketed.

It is a further object of the present invention to provide a new adjustable window covering apparatus, which is of a durable and reliable construction.

An even further object of the present invention is to provide a new adjustable window covering apparatus which is susceptible of a low cost of manufacture with regard to both materials and labor, and which accordingly is then susceptible of low prices of sale to the consuming public, thereby making such adjustable window covering apparatus economically available to the buying public.

Still yet another object of the present invention is to provide a new adjustable window covering apparatus, which provides in the apparatuses and methods of the prior art some of the advantages thereof, while simultaneously overcoming some of the disadvantages normally associated therewith.

Still another object of the present invention is to provide a new adjustable window covering apparatus for allowing a user to install an adjustable window covering apparatus without the use of measuring tools, levelers or drills.

Yet another object of the present invention is to provide a new adjustable window covering apparatus, which includes a frame that is adapted for engaging a floor of a building proximate the window such that the frame is positioned in front of the window. A covering member is coupled to the frame. The covering member has an area for covering the window. The covering member is adapted for inhibiting viewing into the building from outside the building when the frame is positioned proximate the window of the building.

Still yet another object of the present invention is to provide a new adjustable window covering apparatus that eliminates the need to use measuring tools, levelers, drills and other difficult instrumentation.

Even still another object of the present invention is to provide a new adjustable window covering apparatus that provides additional privacy when used with curtains, tapestries or quilts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
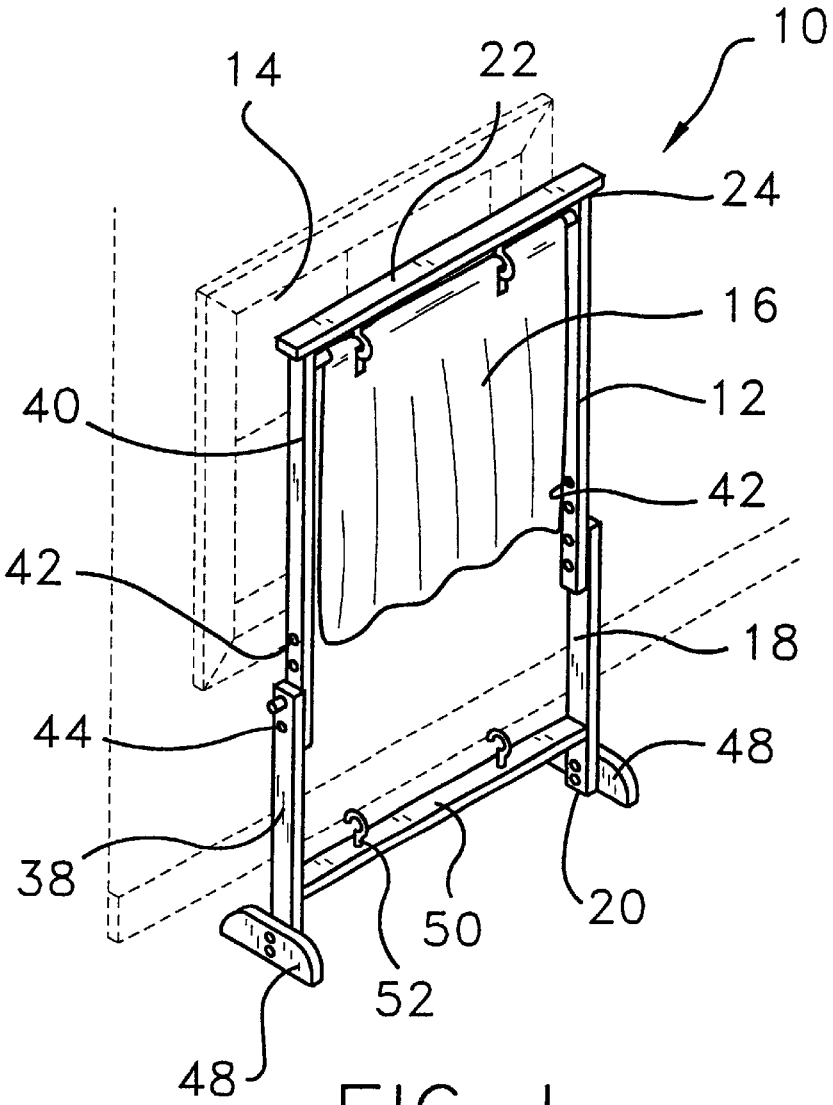
FIG. 1 is a perspective view of a new adjustable window covering apparatus according to the present invention.
Figure 3:
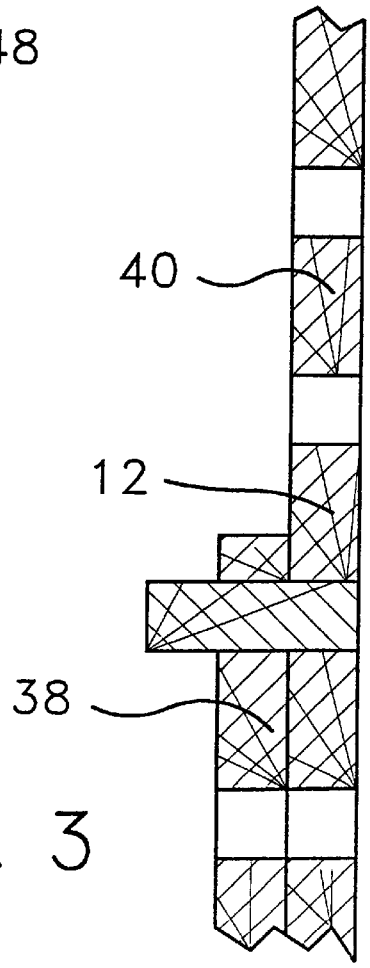
FIG. 3 is a side view of the present invention.
Figure 2:
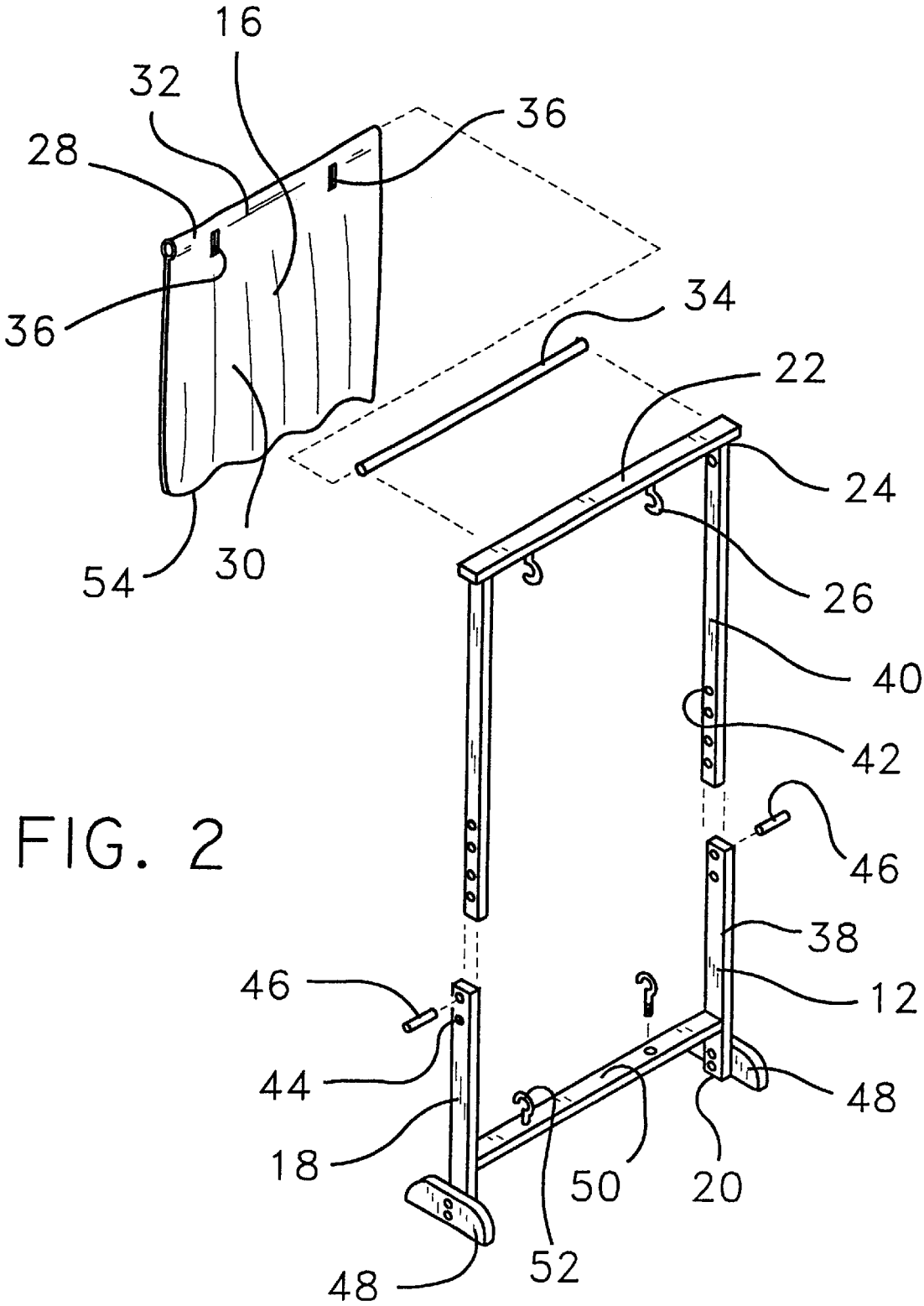
FIG. 2 is an expanded view of the present invention.
Figure 4:
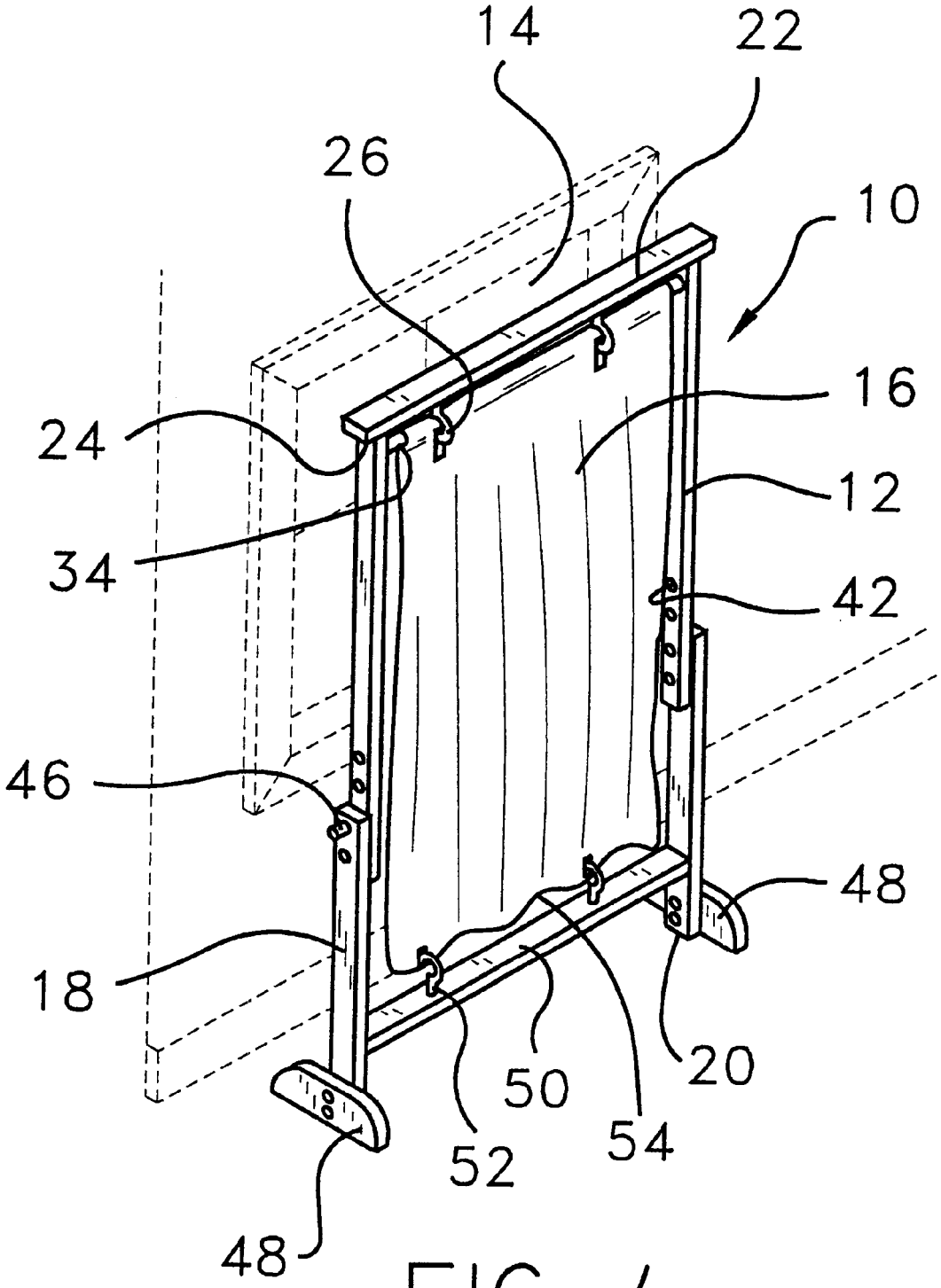
FIG. 4 is a perspective view of the present invention.

With reference now to the drawings, and in particular to FIGS. 1 through 4 thereof, a new adjustable window covering apparatus embodying the principles and concepts of the present invention and generally designated by the reference numeral 10 will be described.

As best illustrated in FIGS. 1 through 4, the adjustable window covering apparatus 10 generally includes a frame 12 that is adapted for engaging a floor of a building proximate the window 14 such that the frame 12 is positioned in front of the window 14. A covering member 16 is coupled to the frame 12. The covering member 16 has an area for covering the window 14. The covering member 16 is adapted for inhibiting viewing into the building from outside the building when the frame 12 is positioned proximate the window 14 of the building.

The frame 12 has a pair of stanchions 18. A bottom end 20 of the stanchions 18 is adapted for resting on the floor of the building. A top member 22 is coupled to a top end 24 of each of the stanchions 18 such that the top member 22 maintains the stanchions 18 in a spaced relationship. The covering member 16 is positioned between the stanchions 18 such that the covering member 16 is adapted to be positioned in front of the window 14 when the frame 12 is positioned proximate the window 14 of the building.

The top member 22 has a pair of hook members 26. The hook member 26 is positioned between the stanchions 18. The hook members 26 selectively engage the covering member 16 such that the hook members 26 are for supporting the covering member 16 between the stanchions 18.

The covering member 16 has a sleeve portion 28 and a panel portion 30. The sleeve portion 28 is coupled along a top edge 32 of the panel portion 30. A rod member 34 is insertable into the sleeve portion 28 of the covering member 16. The hook member 26 receives the rod member 34 such that the covering member 16 is selectively coupled to the top member 22 of the frame 12. The covering member 16 has a pair of slots 36. Each of the slots 36 permit an extension of one of the hook members 26 of the top member 22 around the rod member 34 such that the covering member 16 is not compressed between the rod member 34 and one of the hook members 26 of the top member 22 of the frame 12.

Each of the stanchions 18 has a base portion 38 and an extension portion 40. The base portion 38 of each of the stanchions 18 is adapted for resting on the floor of the building. The extension portion 40 of each of the stanchions 18 is coupled to the top member 22. The extension portion 40 of each of the stanchions 18 is selectively couplable to the base portion 38 of an associated one of the stanchions 18 such that a length of the stanchion 18 is adjustable.

The extension portion 40 of each of the stanchions 18 has a plurality of adjustment apertures 42. The base portion 38 of each of the stanchions 18 has a plurality of anchoring apertures 44. Each of the adjustment apertures 42 of one of the stanchions 18 is alignable with one of the anchoring apertures 44 of the base portion 38 of the associated one of the stanchions 18.

A plurality of locking pins 46 each is insertable into one of the anchoring apertures 44 of the base portion 38 of one of the stanchions 18. Each of the locking pins 46 is extendable through one of the adjustment apertures 42 of the extension portion 40 of the associated one of the stanchions 18 aligned with one of the anchoring apertures 44 of the base portion 38 for securing the stanchion 18 at the length desired by a user.

Each of the stanchions 18 has a foot portion 48. The foot portion 48 is coupled to the bottom end 20 of the associated one of the stanchions 18. The foot portion 48 of each of the stanchions 18 is adapted for supporting the frame 12 on the floor of the building.

The frame 12 has a bottom member 50. The bottom member 50 is coupled between the stanchions 18. The bottom member 50 is for providing support to the frame 12 when the frame 12 is positioned proximate the window 14 of the building. The bottom member 50 of the frame 12 has a plurality of securing members 52. Each of the securing members 52 is selectively couplable to a bottom edge 54 of the covering member 16 such that the securing members 52 are for keeping the covering member 16 positioned within the within the frame 12 when the frame 12 is positioned proximate the window of the building.

In use, a user would position the present invention proximate a window. The user could then adjust the frame to the desired height for optimally covering a window. The present invention could also be used as a room divider providing the user with separation within a room.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable window covering apparatus for inhibiting viewing through a window, the adjustable window covering apparatus comprising:

a frame being adapted for engaging a floor of a building proximate the window such that said frame is positioned in front of the window;

a covering member being coupled to said frame, said covering member having an area for covering the window, said covering member being adapted for inhibiting viewing into the building from outside the building when said frame is positioned proximate said the window of the building;

said frame having a pair of stanchions, a bottom end of said stanchions being adapted for resting on the floor of the building, a top member being coupled to a top end of each of said stanchions such that said top member maintains said stanchions in a spaced relationship, said covering member being positioned between said stanchions such that said covering member is adapted for being positioned in front of the window when said frame is positioned proximate the window of the building;

said top member having a pair of hook members, said hook member being positioned between said stanchions, said hook members selectively engaging said covering member such that said hook members are for supporting said covering member between said stanchions;

said covering member having a sleeve portion and a panel portion, said sleeve portion being coupled along a top edge of said panel portion; and a rod member being insertable into said sleeve portion of said covering member, said rod member being received by said hook members such that said covering member is selectively coupled to said top member of said frame.

2. The adjustable window covering apparatus as set forth in claim 1, further comprising:

said covering member having a pair of slots, each of said slots permitting extension of one of said hook members of said top member around said rod member such that said covering member is not compressed between said rod member and one of said hook members of said top member of said frame.

3. The adjustable window covering apparatus as set forth in claim 1, further comprising:

each of said stanchions having a base portion and an extension portion, said base portion of each of said stanchions being adapted for resting on the floor of the building, said extension portion of each of said stanchions being coupled to said top member, said extension portion of each of said stanchions being selectively couplable to said base portion of an associated one of said stanchions such that a length of said stanchion is adjustable.

4. The adjustable window covering apparatus as set forth in claim 3, further comprising:

said extension portion of each of said stanchions having a plurality of adjustment apertures, said base portion of each of said stanchions having a plurality of anchoring apertures, each of said adjustment apertures of one of said stanchions being alignable with one of said anchoring apertures of said base portion of the associated one of said stanchions; and a plurality of locking pins each being insertable into one of said anchoring apertures of said base portion of one of said stanchions, each of said locking pins being extendable through one of said adjustment apertures of said extension portion of the associated one of said stanchions aligned with one of said anchoring apertures of said base portion for securing said stanchion at said length desired by a user.

5. The adjustable window covering apparatus as set forth in claim 1, further comprising:

each of said stanchions having a foot portion, said foot portion being coupled to said bottom end of the associated one of said stanchions, said foot portion of each of said stanchions being adapted for supporting said frame on the floor of the building.

6. The adjustable window covering apparatus as set forth in claim 1, further comprising:

said frame having a bottom member, said bottom member being coupled between said stanchions, said bottom member being for providing support to said frame when said frame is positioned proximate the window of the building.

7. The adjustable window covering apparatus as set forth in claim 6, further comprising:

said bottom member of said frame having a plurality of securing members, each of said securing members being selectively couplable to a bottom edge of said covering member such that said securing members are for keeping said covering member positioned within said within said frame when said frame is positioned proximate the window of the building.

8. An adjustable window covering apparatus for inhibiting viewing through a window, the adjustable window covering apparatus comprising:

a frame being adapted for engaging a floor of a building proximate the window such that said frame is positioned in front of the window;

a covering member being coupled to said frame, said covering member having an area for covering the window, said covering member being adapted for inhibiting viewing into the building from outside the building when said frame is positioned proximate said the window of the building;

wherein said frame having a pair of stanchions, a bottom end of said stanchions being adapted for resting on the floor of the building, a top member being coupled to a top end of each of said stanchions such that said top member maintains said stanchions in a spaced relationship, said covering member being positioned between said stanchions such that said covering member is adapted for being positioned in front of the window when said frame is positioned proximate the window of the building;

wherein said top member having a pair of hook members, said hook member being positioned between said stanchions, said hook members selectively engaging said covering member such that said hook members are for supporting said covering member between said stanchions;

wherein said covering member having a sleeve portion and a panel portion, said sleeve portion being coupled along a top edge of said panel portion;

a rod member being insertable into said sleeve portion of said covering member, said rod member being received by said hook members such that said covering member is selectively coupled to said top member of said frame;

wherein said covering member having a pair of slots, each of said slots permitting extension of one of said hook members of said top member around said rod member such that said covering member is not compressed between said rod member and one of said hook members of said top member of said frame;

wherein each of said stanchions having a base portion and an extension portion, said base portion of each of said stanchions being adapted for resting on the floor of the building, said extension portion of each of said stanchions being coupled to said top member, said extension portion of each of said stanchions being selectively couplable to said base portion of an associated one of said stanchions such that a length of said stanchion is adjustable;

wherein said extension portion of each of said stanchions having a plurality of adjustment apertures, said base portion of each of said stanchions having a plurality of anchoring apertures, each of said adjustment apertures of one of said stanchions being alignable with one of said anchoring apertures of said base portion of the associated one of said stanchions;

a plurality of locking pins each being insertable into one of said anchoring apertures of said base portion of one of said stanchions, each of said locking pins being extendable through one of said adjustment apertures of said extension portion of the associated one of said stanchions aligned with one of said anchoring apertures of said base portion for securing said stanchion at said length desired by a user;

wherein each of said stanchions having a foot portion, said foot portion being coupled to said bottom end of the associated one of said stanchions, said foot portion of each of said stanchions being adapted for supporting said frame on the floor of the building;

wherein said frame having a bottom member, said bottom member being coupled between said stanchions, said bottom member being for providing support to said frame when said frame is positioned proximate the window of the building; and wherein said bottom member of said frame having a plurality of securing members, each of said securing members being selectively couplable to a bottom edge of said covering member such that said securing members are for keeping said covering member positioned within said within said frame when said frame is positioned proximate the window of the building.

9. An adjustable window covering apparatus for inhibiting viewing through a window, the adjustable window covering apparatus comprising:

a frame being adapted for engaging a floor of a building proximate the window such that said frame is positioned in front of the window;

a covering member being coupled to said frame, said covering member having an area for covering the window, said covering member being adapted for inhibiting viewing into the building from outside the building when said frame is positioned proximate said the window of the building;

said frame having a pair of stanchions, a bottom end of said stanchions being adapted for resting on the floor of the building, a top member being coupled to a top end of each of said stanchions such that said top member maintains said stanchions in a spaced relationship, said covering member being positioned between said stanchions such that said covering member is adapted for being positioned in front of the window when said frame is positioned proximate the window of the building;

said frame having a bottom member, said bottom member being coupled between said stanchions, said bottom member being for providing support to said frame when said frame is positioned proximate the window of the building; and said bottom member of said frame having a plurality of securing members, each of said securing members being selectively couplable to a bottom edge of said covering member such that said securing members are for keeping said covering member positioned within said within said frame when said frame is positioned proximate the window of the building.

* * * * *